US007101214B1

(12) United States Patent
Miller

(10) Patent No.: US 7,101,214 B1
(45) Date of Patent: Sep. 5, 2006

(54) PLUG RETENTION APPARATUS

(75) Inventor: Thomas J. Miller, Chino Hills, CA (US)

(73) Assignee: TMC Enterprises, Diamond Bar, CA (US)

( * ) Notice: Subject to any disclaimer, the term of this patent is extended or adjusted under 35 U.S.C. 154(b) by 0 days.

(21) Appl. No.: 11/209,594

(22) Filed: Aug. 22, 2005

Related U.S. Application Data

(60) Continuation of application No. 11/198,342, filed on Aug. 4, 2005, now abandoned, which is a division of application No. 10/777,401, filed on Feb. 12, 2004, now Pat. No. 6,957,977.

(60) Provisional application No. 60/519,762, filed on Nov. 13, 2003.

(51) Int. Cl.
*H01R 13/62* (2006.01)

(52) U.S. Cl. ..... 439/369

(58) Field of Classification Search ..... 439/369, 439/371, 373

See application file for complete search history.

(56) References Cited

U.S. PATENT DOCUMENTS

| | | | |
|---|---|---|---|
| 1,665,095 | A | 4/1928 | Henry |
| 2,753,536 | A | 7/1956 | Tjader |
| 4,204,738 | A | 5/1980 | Tilotson |
| 4,875,874 | A | 10/1989 | Windsor, Jr. |
| 5,211,573 | A | 5/1993 | Cross |
| 5,393,243 | A | 2/1995 | Carmo |
| 5,584,720 | A | 12/1996 | Elswick |
| 5,785,547 | A | 7/1998 | Cross et al. |
| 6,056,580 | A | 5/2000 | Cross et al. |
| 6,080,004 | A | 6/2000 | Kovacik et al. |

*Primary Examiner*—Neil Abrams
(74) *Attorney, Agent, or Firm*—Knobbe Martens Olson & Bear LLP

(57) ABSTRACT

A plug retention apparatus for use in securing two plug members together to prevent undesired disengagement. The plug retention apparatus is affixed to a first plug member using a retention ring which provides a means for adjustable positioning via a threaded coupling to facilitate securing a second plug member to the first plug member. A plug clamp may be rotatably positioned about the second plug member retaining the plug members in a desired position.

8 Claims, 8 Drawing Sheets

PLUG RETENTION APPARATUS

RELATED APPLICATIONS

This application is a continuation of U.S. patent application Ser. No. 11/198,342, filed Aug. 4, 2005, now abandoned, which is a divisional of U.S. patent application Ser. No. 10/777,401, filed Feb. 12, 2004, now U.S. Pat. No. 6,957,977, and claims the benefit of U.S. Provisional Application 60/519,762, filed Nov. 13, 2003, all of which are hereby incorporated by reference in their entirety herein.

BACKGROUND

1. Field of the Invention

The present teachings relate to electrical cords and, in particular, to a device and methods for maintaining engagement between electrical plug connections.

2. Description of the Related Art

Electrical devices such as power tools, household appliances, and other consumer electronics often possess a cord having a plug to be engaged with a receiving socket such as that found on an extension cord or the like. The cords of these devices are subject to snagging and may be easily disengaged, interrupting the electrical connection and posing a potential safety hazard if the plug becomes partially disengaged to expose the contacts.

To improve safety, it has been suggested to position a retaining structure over the connected plugs or sockets to prevent disengagement of the plugs. Unfortunately, typical retaining structures are not adaptable to fit different sizes of electrical plugs. For example, U.S. Pat. No. 4,204,738 to Tillotson illustrates a typical electrical cord securing device that has a securing member attached to the male end of an electrical cord. The securing member is adapted to attach to the mating electrical cord. However, the securing member is not adjustable. Hence, the cord that is to be attached and secured with this device must be sized to for the securing device which limits the use of the securing device to just a single cord.

Other retaining structures disclosed in the prior art attach to the cord but, unfortunately, bend the cord in detrimental contours to inhibit disengagement of the plugs. In general, bending the cord does not provide as secure of attachment and can also weaken the structural integrity of the cord with excessive wear and tear via bending. Still other retaining structures in the prior art are inconvenient and use complex housings that do not allow for quick connect and disconnect. These types of retaining structures are inefficient and require a large amount of time to construct, deconstruct, and reconstruct for each use.

As a result, there is a need for a clamp assembly that is adapted to provide a secure engagement between electrical plugs or socket connectors that can be adjusted to accommodate various plug or connector assemblies and configurations. To this end, there exists a need to improve the safety of clamp assemblies by maintaining the secure engagement between electrical plugs or socket connectors.

SUMMARY

In various embodiments, the present teachings describe a plug retention device used in conjunction with a socketed electrical cord wherein the electrical cord comprises a first plug member that is retained in contact with a second plug member by way of a securing clamp. At least one plug member is threaded to accommodate a retention ring that may be adjustably positioned about the threaded plug member. A plug clamp is attached to the retention ring in such a manner so as to allow pivotal positioning. The plug clamp further comprises a cord guide which secures the cord and allows it to be passed through a portion of the plug clamp in an unobstructed manner. In various embodiments, the first plug member comprises a male plug member having at least one conductive element extending therefrom and the second plug member comprises a female plug member having a receiving socket into which the at least one conductive element is desirably secured to establish an electrical connection between the two plug members. The plug retention device secures the connection between plug members via the plug clamp which is positioned about one of the plug members and retained in a first position preventing axial movement of the plug members by the retention ring secured to the opposing plug member.

In one embodiment, the aforementioned needs may be satisfied by an electrical cord assembly comprising a cord suitable for supplying electrical power to an appliance and a first plug member attached to the cord, wherein the first plug member includes a threaded surface, and wherein the first plug member is adapted to couple to a second plug member having an associated cord so as to provide electrical power thereto. The electrical cord assembly may further comprise a retainer assembly threadably engaged with the first plug member so as to be movable in a direction either towards or away from the first plug member wherein the retainer assembly includes an engagement member that engages with the cord attached to the second plug member and wherein the retainer assembly can be threadably moved on the first plug member such that the engagement member can be tightened against the second plug member to thereby retain the first and second plug members in contact with each other.

In one aspect, the first plug member comprises a male electrical cord plug. The first plug member includes a body having a first and a second end and an outer surface extending from the first and the second end, and wherein the first end is adapted to be engaged with the second plug member and the second end is connected to the cord and wherein the outer surface of the plug body comprises the threaded surface. The retainer assembly comprises a collar that is threaded so as to be threadably engaged with the threaded surface of the first plug member and wherein the engagement member is pivotally mounted to the collar so as to be movable between a first position and a second position.

In another aspect, the engagement member comprises two members that each attach to the collar and a cross piece interconnecting the two members and wherein the cross piece includes an engagement surface that engages with the cord on the second plug assembly. The engagement surface comprises a depression in the cross piece that is contoured so as to fit around the cord of the second plug assembly. The engagement member further comprises a securing member pivotally attached to the cross piece so as to be movable between an open position and a closed position wherein the securing member in the open position allows the second cord to be positioned in the depression and wherein the securing member in the closed position allows the second cord to be secured in the depression. The engagement members are pivotally attached to the collar member such that the engagement member can be secured to the first cord when the retainer assembly is not in use securing the first and second plugs together.

The aforementioned needs may also be satisfied by a cord assembly comprising, in one embodiment, a first cord member suitable for conducting electricity and a first plug member electrically coupled to the first cord member, wherein the first plug member includes a threaded shaft portion interposed between a head portion and a base portion, wherein the first plug member is adapted to receive a second plug member adjacent the head portion. In addition, the cord assembly may further comprise a ring member having threads that engage the threaded shaft portion of the first plug member, wherein the ring member is movable along the shaft portion between the head and base portions of the plug member. Moreover, the cord assembly may further comprise a clamp member attached to the ring member so as to pivot about the point of attachment, wherein the clamp member couples with a second cord member that is electrically coupled to the second plug member, and wherein the clamp member secures the second plug member adjacent the first plug member when the ring member is threaded towards the base portion of the first plug member, and wherein the clamp member is loosened when the ring member is threaded towards the head portion of the first plug member.

The aforementioned needs may also be satisfied by a method of interconnecting two electrical cords with matching plugs. In one embodiment, the method comprises inserting a first plug assembly of the first electrical cord to a second plug assembly of the second electrical cord and threadably engaging a retaining structure onto the first cord assembly. In addition, the method further comprises coupling the retaining structure to the second electrical cord and threadably moving the retaining structure with respect to the first plug assembly such that a portion of the retaining structure engages the second plug assembly and urges the second plug assembly towards the first plug assembly to thereby inhibit disengagement between the first and second plug assemblies.

These and other aspects, advantages, and novel features of the present teachings will become apparent upon reading the following detailed description and upon reference to the accompanying drawings.

DETAILED DESCRIPTION OF CERTAIN EMBODIMENTS

Reference will now be made to the drawings wherein like numerals refer to like parts throughout. An apparatus for maintaining engagement between electrical plug connections will be described in greater detail herein below with reference to the drawings.

Figure 1:
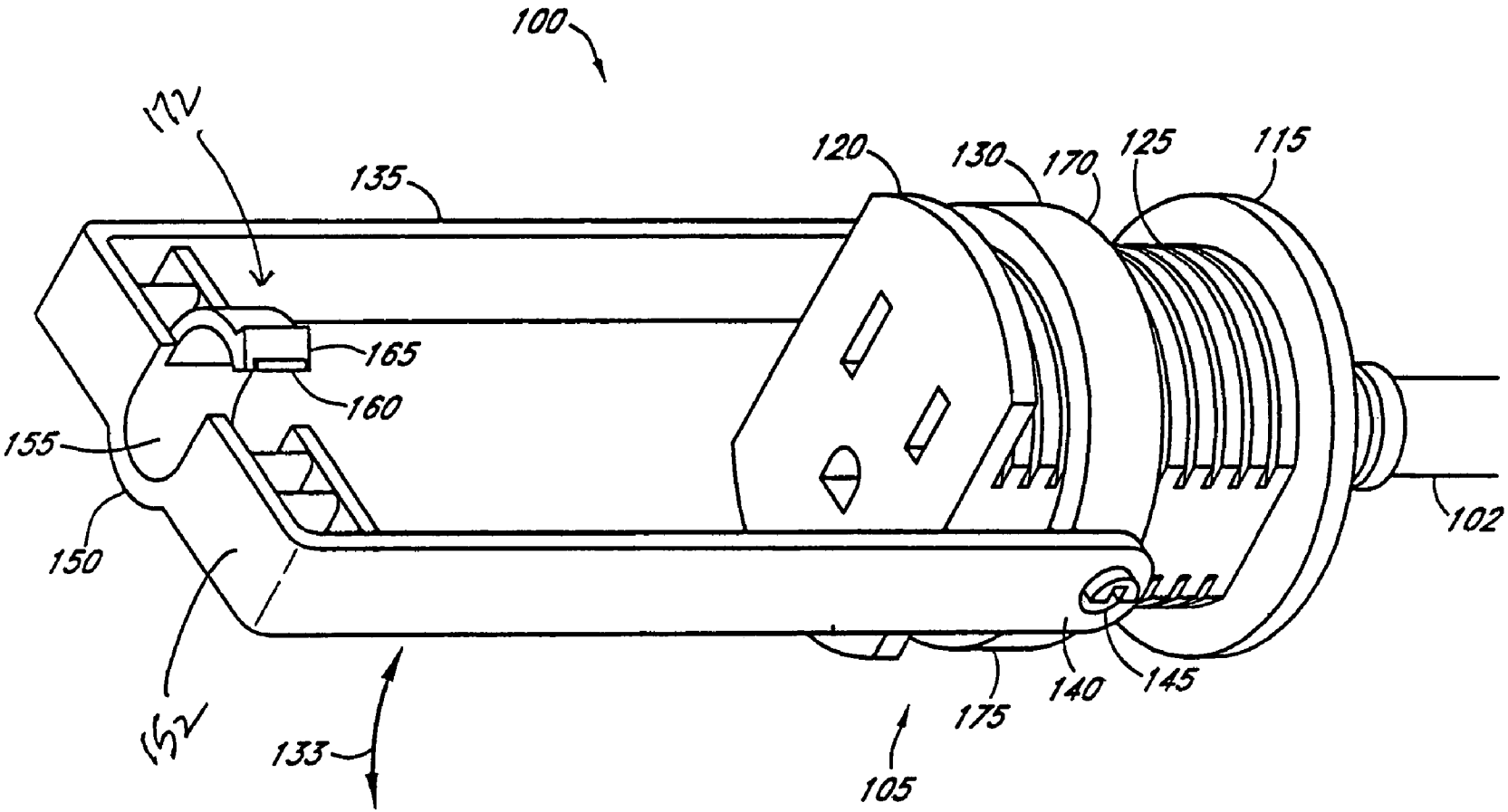
FIGS. 1–3 illustrate one embodiment of the plug retention apparatus.

FIG. 1 illustrates one embodiment of a plug retention apparatus 100. The plug retention apparatus 100 comprises a first plug member 105 attached to one end of an electrical cord 102 having a receiving socket 110 adapted to receive conductive elements of a second plug member 200 (FIGS. 4–7). In general, the electrical cord 102 may comprise any cord member suitable for supplying electrical power to a household or commercial device, such as an appliance. In various embodiments, the first plug member 105 comprises a female plug that is adapted to accommodate connection to conventional electrical cords such as those found on household electronics, power tools, and the like. It should be appreciated, however, that the first plug member 105 may also comprise a male plug that is adapted to accommodate connection to conventional electrical cords.

The first plug member 105 further comprises a base portion 115 and a head portion 120 having a threaded section 125 disposed between the base portion 115 and the head portion 120. In one aspect, the threaded section 125 comprises a threaded shaft interposed between the base and head portions 115, 120 of the first plug member 105. Also, the threaded section or shaft 125 is an integral part of the plug member 105. In addition, a retention ring or collar 130 is secured to the first plug member 105 about the threaded section 125, wherein the retention ring 130 is adapted to moveably engage the first plug member 105 about the threaded section 125. In one aspect, the retention ring comprises a threaded interior surface that is adapted to engage the threaded section 125 of the first plug member 105. Advantageously, this allows the retention ring 130 to move along the threaded section 125 between the base and head portions 115, 120 of the first plug member 105.

Additionally, in various embodiments, the retention ring 130 may be positioned about the first plug member 105 by rotational motion in which the retention ring 130 is adapted to engage the threaded section 125 to move up or down as desired. In one aspect, axial movement of the retention ring 130 about the first plug member 105 is constrained between the base portion 115 and the head portion 120 such that the retention ring 130 is constrained to a range of positions. As will be described in greater detail herein below, movement and positioning of the retention ring 130 in the aforementioned manner desirably provides a means by which to adjust the retention ring 130 to accommodate joining of the second plug member with the first plug member 105 to be thereafter secured in position preventing undesirable disengagement.

Figure 4:
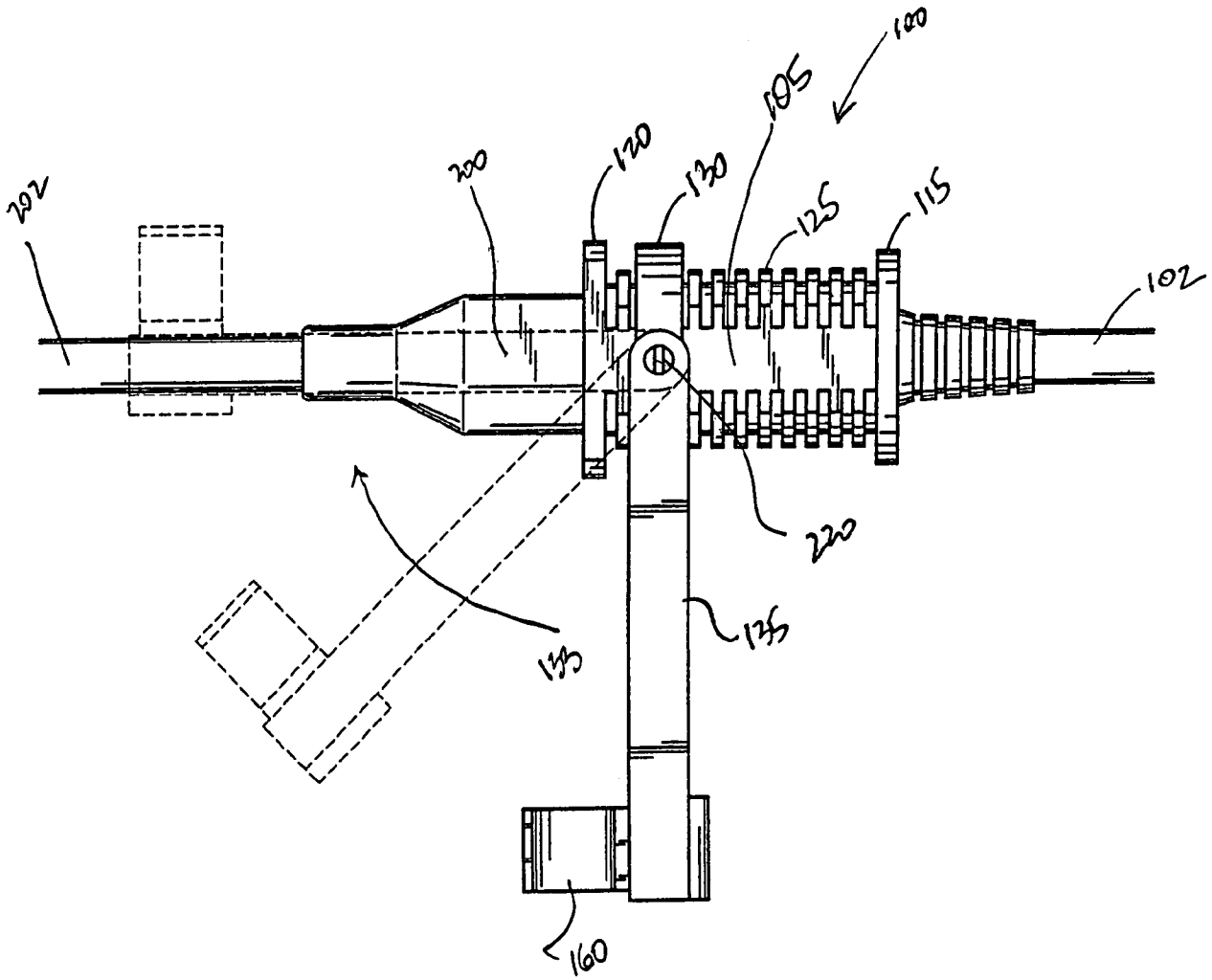
FIG. 4 illustrates the pivotal movement of a member of the plug retention apparatus.

A plug clamp 135 is further secured to the retention ring 130, wherein the plug clamp 135 comprises a U-shaped member having first and second pivot ends 140. Each pivot end 140 may comprise through-going opening adapted to receive a grommet portion 145 of the retention ring 130 that secures the plug clamp 135 to the retention ring 135. When attached in this manner, the plug clamp 135 may be angularly pivoted 133 from the first plug member 105 to facilitate joining with the second plug member 200 as illustrated in FIG. 4.

Additionally, the plug clamp 135 further comprises a cord guide 150 positioned along a cross member portion 152 of the plug clamp 135. The cord guide 150 comprises an opening 155 in the plug clamp 135 which is adapted to receive a portion of an electrical cord attached to the second plug member. In one aspect, the cord guide 150 allows passage of the electrical cord attached to the second plug member 200 through a portion of the plug clamp 135 in a substantially unobstructed manner while at the same time retaining the electrical cord 102 in a desired position.

Figure 5:
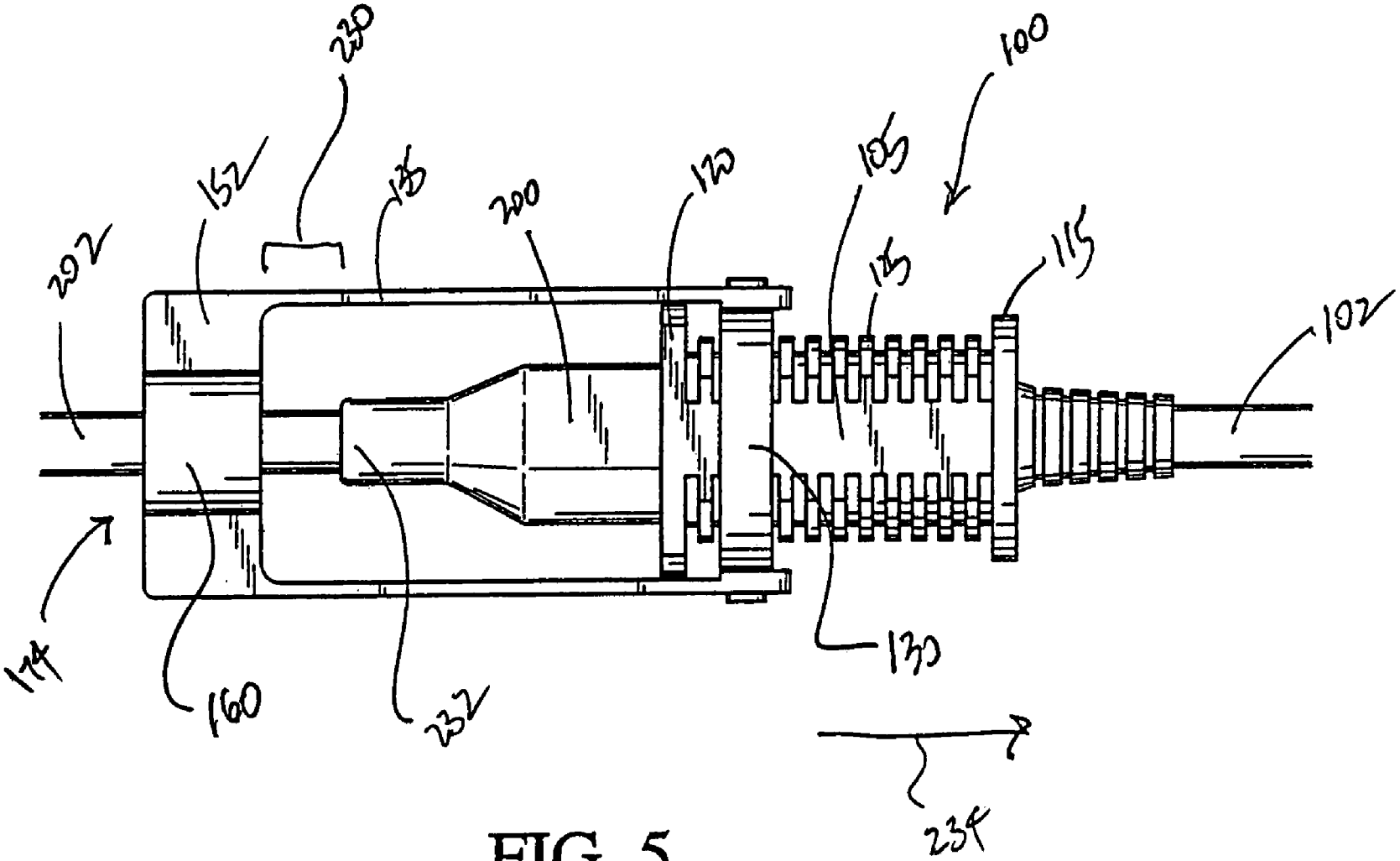
FIGS. 5–6 illustrate one embodiment of securing a plurality of cord members with the plug retention apparatus.
Figure 6:
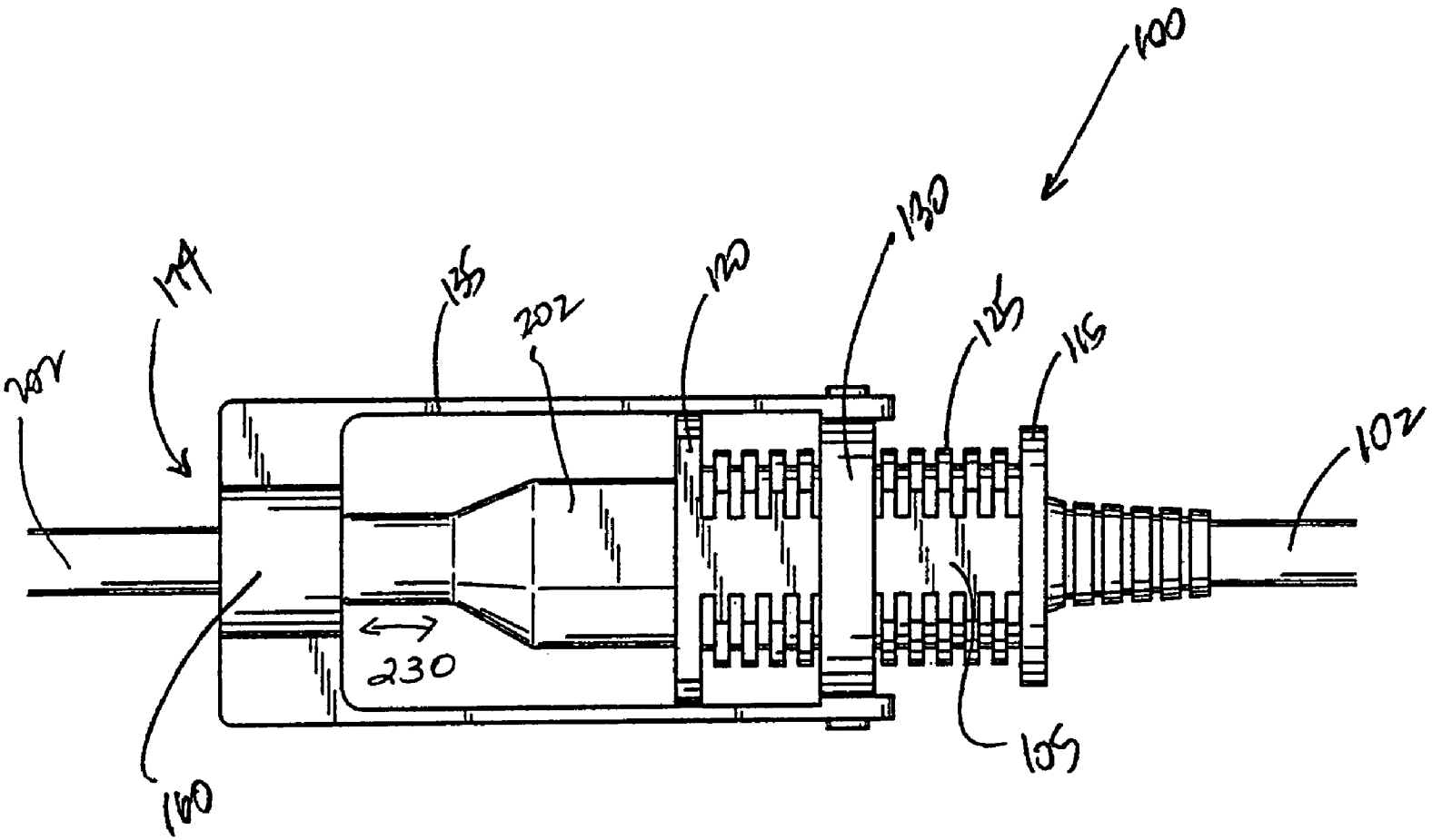

Moreover, in one aspect, the cord guide 150 comprises a latching member 160 that may reside in a first open position 172 as illustrated in FIG. 1, wherein an opening is formed to allow the electrical cord 102 attached to the second plug member 200 to be captured within the opening 155 of the cord guide 150. The latching member 160 may be further retained in a second closed position 174, as illustrated in FIGS. 5–6, so as to be secured to a portion of the cord guide 150 by way of a latch 165. When so positioned as described for example, the latching member 160 may be adapted to capture a portion of the electrical cord 102 passed through the cord guide 150 allowing the electrical cord 102 to be angularly positioned above the first plug member 105 as the plug clamp 135 is moved into position about the second plug member 200 (FIG. 4).

In various embodiments, the ring member 130 may comprise detachable sections 170, 175 which allow for placement and removal from the threaded section 125. The detachable sections 170, 175 may further be secured via the grommets 145 which join the detachable sections 170 upon fastening of the plug clamp 135. Taken together the construction of the plug retention apparatus 100 is such that it may be designed as a part integrated into the first plug member 105 or alternatively may be adapted as a removable component. In one aspect, as illustrated in FIG. 4, the plug clamp 135 pivots about the grommets 145 so as to capture a portion of the electrical cord 102 within the opening 155 of the cord guide 150.

Figure 2:
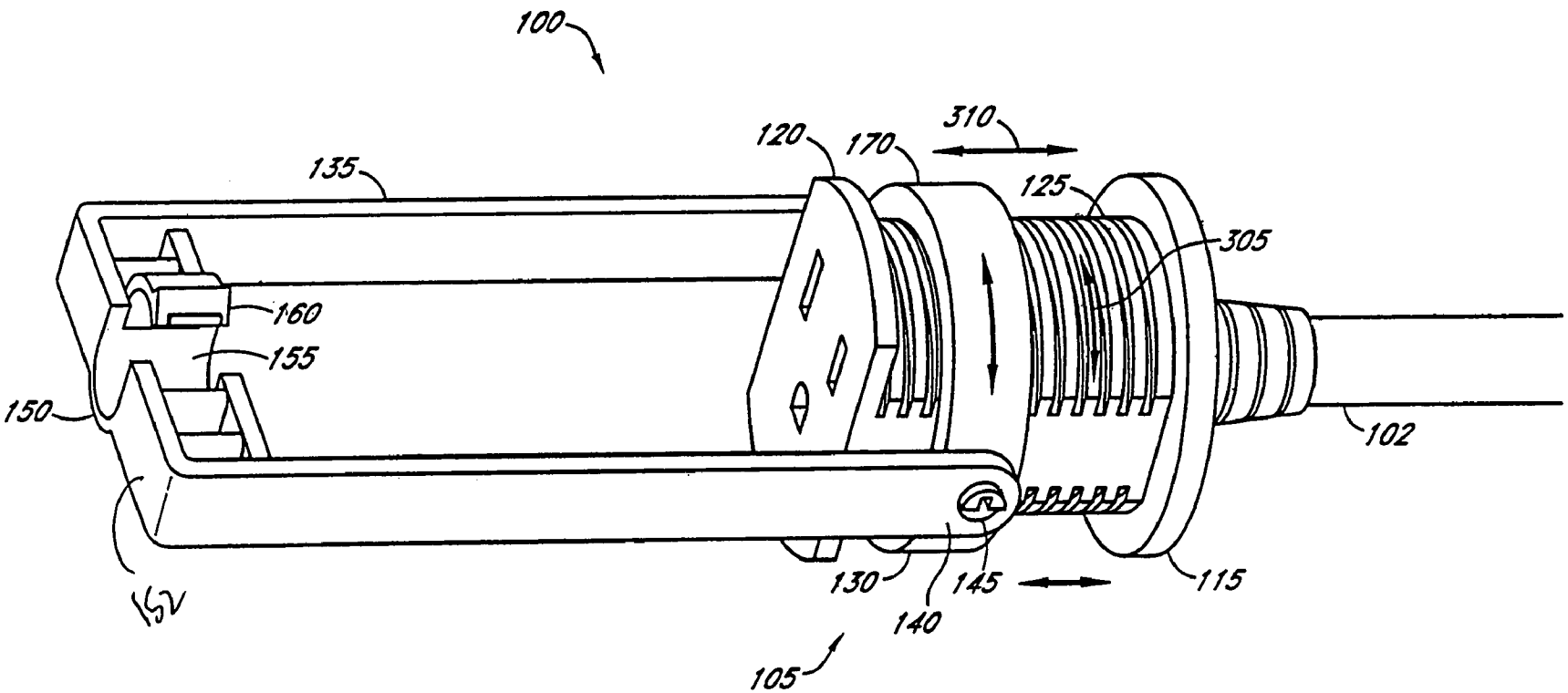
Figure 3:
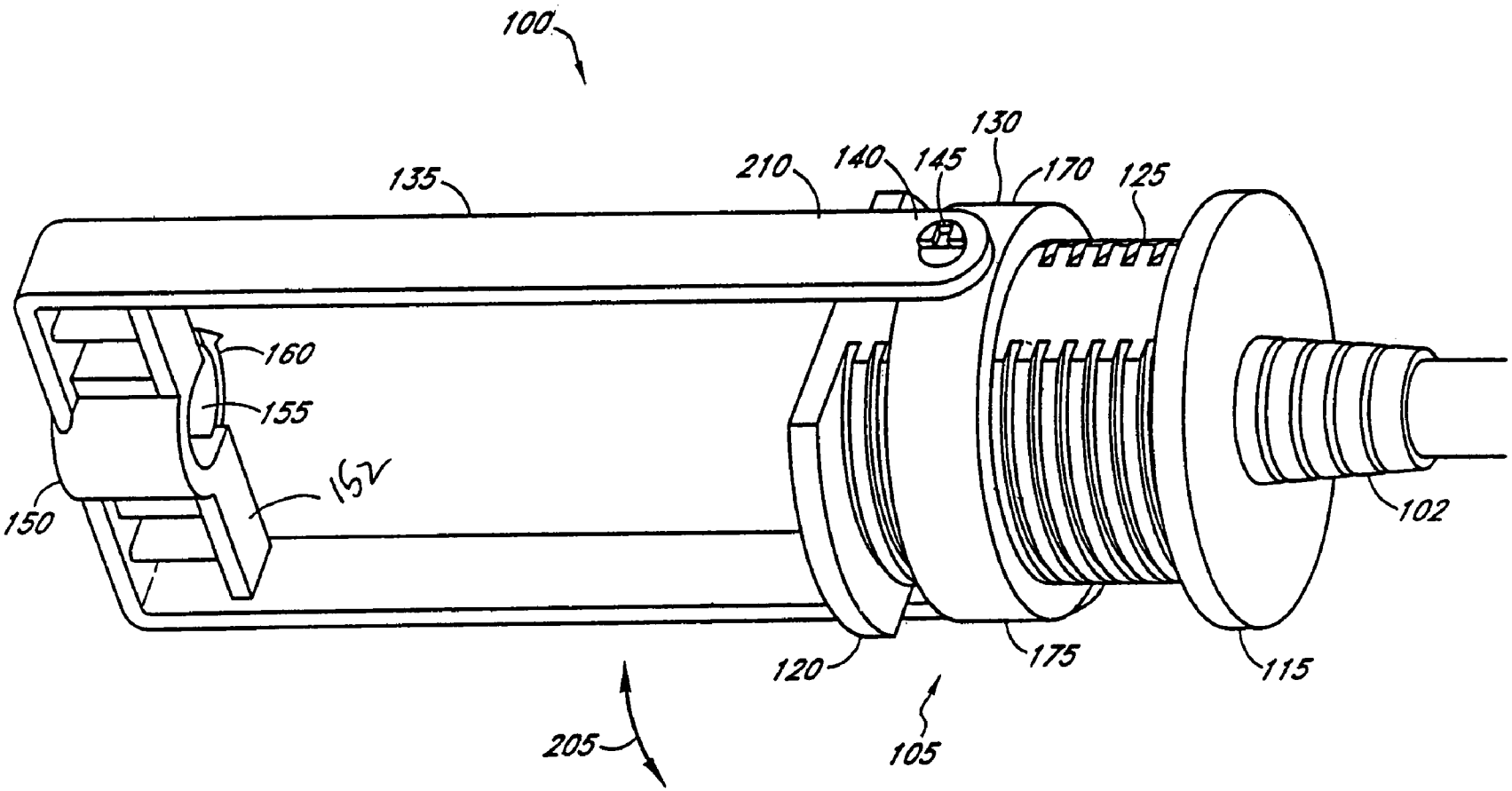

FIG. 2 illustrates a rear perspective view of the plug retention apparatus 100. FIG. 3 illustrates a side perspective view of the plug retention apparatus 100 wherein positioning of the retention ring is used to secure the first and second plug members 105, 200. In one aspect, as illustrated in FIGS. 2–3, the general construction of the plug clamp 135 and cord guide 150 from this perspective further illustrates how the electrical cord 102 may be retained within the opening 155 of the cord guide 150. In addition, the pivot arrows 205, 210 indicate how the plug clamp 135 may be positioned to accommodate joining of the second plug member 200 with the first plug member 105. Once the plug members 105, 200 have been engaged in a manner as illustrated in FIGS. 4–7, the plug clamp 135 may be repositioned over the second plug member 200, wherein the cord guide 150 captures the electrical cord 202 associated with the second plug member 200.

Figure 7:
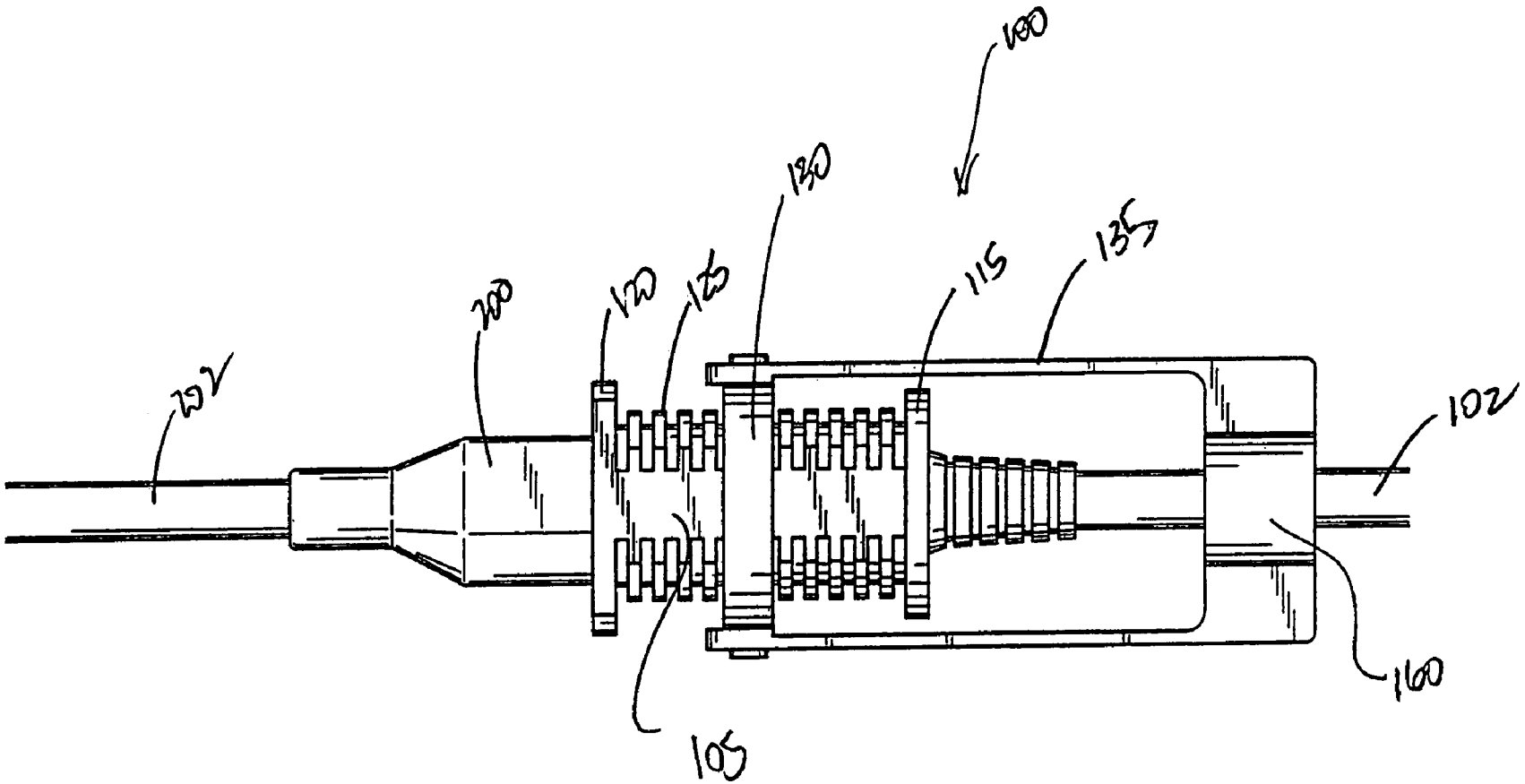
FIG. 7 illustrates another embodiment of securing the plug retention apparatus to a cord member.

As further illustrated in FIGS. 2–3, the retention ring 130 may be rotatably positioned about the threaded member 125 as illustrated by arrow 305. In one aspect, as illustrated in FIGS. 5–6, rotation of the retention ring 130 engages the threads of the threaded member 125 in such a manner so as to result in axial movement 310 along the shaft of the threaded member 125 of the plug retention apparatus 100. Advantageously, this allows ring member 130 including the plug clamp 135 to move axially between the base portion 115 and the head portion 120 of the first plug member 105 so as to secure the second plug member 200 to the first plug member 105. In this position, the second plug member 200 is positioned adjacent the head portion 120 of the first plug member 105. In addition, the retention ring 130 is desirably positioned about the threaded member 125 in such a manner so that when the first plug member 105 is engaged with the second plug member 200 and the plug clamp 135 is positioned about the second plug member 200 the connection between the two plug members 105, 200 is secured. Moreover, as illustrated in FIG. 7, the clamp member 135 can be pivotally attached to the ring member 130 such that the clamp member 135 can be secured to the first cord member 102 when the plug retention apparatus 100 is not in use securing the first and second plug members 105, 200 together.

In one aspect, the secured position between the two plug members 105, 200 may be accomplished by rotating the plug clamp 135 into a position wherein its axial position is generally in-line with the first plug member 105. When so positioned the plug clamp 135 is retained in an axially fixed position by the retention ring 130. Thus, when so positioned the first and second plug members 105, 200 are desirably secured and resistant to separation. Moreover, the opening 155 in the cord guide 150 can be used to capture the electrical cord 202 extending from the second plug member 200 and the latching member 160 closed to thereby secure the electrical cord 202 extending therefrom.

FIG. 4 further illustrates a method of securing cord members including the first and second cords 102, 202. In one embodiment, the method comprises engaging the first plug member 105 to the second plug member 200. As previously described, the first plug member 105 is electrically coupled to the first cord member 102 and includes the plug clamp 135 that pivots about a pivot point 220 on the retention ring 130. The plug clamp 135 is secured to the retention ring 130 via the first and second pivot ends 140 in a manner such that each pivot end 140 includes throughgoing apertures that are adapted to receive the protruding grommets 145 of the retention ring 130. As illustrated in FIG. 4, when attached in this manner, the plug clamp 135 may be angularly pivoted 133 from the first plug member 105 to facilitate coupling with the second cord member 202. In addition, the retention ring 130 threadably couples to the threaded shaft portion 125 of the first plug member 105.

FIG. 5 illustrates the coupling of the plug clamp 135 to the second cord member 202. In one embodiment, as illustrated in FIG. 5, when the retention ring 130 is positioned adjacent to the head portion 120 of the first plug member 105, the cross member portion 152 of the plug clamp 135 is positioned a first distance 230 from a rear portion 232 of the second plug member 200. In this position, the retention ring 130 can be threaded along the shaft portion 125 of the first plug member 105 in a first direction 234 towards the base portion 115 of the first plug member 105 so as to close the gap of the first distance 230 therebetween.

FIG. 6 illustrates the positioning of the plug clamp 135 adjacent to the second cord member 202. In one embodiment, as illustrated in FIG. 6, when the retention ring 130 is threaded towards the base portion 115 of the first plug member 105, the cross member portion 152 of the plug clamp 135 is positioned adjacent to the rear portion 232 of the second plug member 200. In this position, the retention ring 130 is threadably tightened or cinched along the shaft portion 125 of the first plug member 105 in the first secure the second plug member 200 to the first plug member 105. This position further closes the gap of the first distance 230 therebetween so that the second plug member 202 cannot be removed from the first plug member 105. Advantageously, the threaded connection between the retention ring 130 of the plug clamp 135 and the shaft portion 125 of the first plug member 105 allows the second plug member 202 to be secured to the first plug member 105 without interfering with the electrical conduction therebetween. Additionally, this method of securing a plurality of cord members together improves operational safety by reducing the risk of disengaging the plug members 105, 200 during use.

FIG. 7 illustrates the ability of the plug clamp 135 of the first plug member 105 to be secured to the first cord member 102 during times of non-use or non-operation. In addition, this position also allows the second plug member 200 to be removed or disengaged from the first plug member 105. It should be appreciated that the method as disclosed in FIGS. 4–6 can be reversed in order so as to pivot the plug clamp away from the second cord member 202 and towards the first plug member 105 so as to couple the plug clamp 135 to the first plug member 102. Advantageously, this position prevents the clamp member 135 from flailing about during non-use, transport, or for storage.

Figure 8:
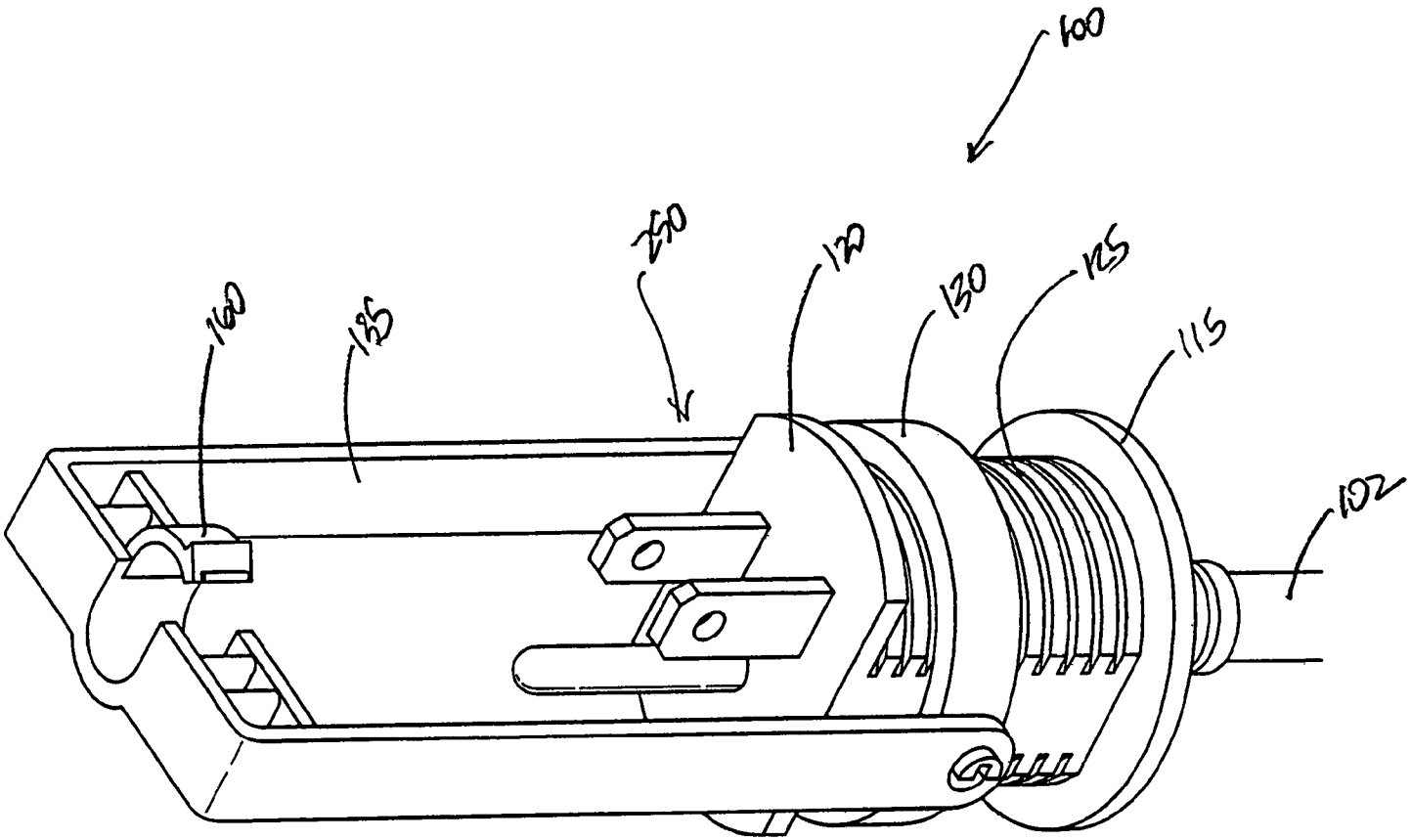
FIG. 8 illustrates another embodiment of the plug retention apparatus.

It should be appreciated by those skilled in the art that the plug retention apparatus 100 may be adapted to a male plug member 250 in manner as illustrated in FIG. 8. Also, the retention ring 130 may be adapted to be secured to and moved about the male plug member 250 in a similar manner as previously described with reference to the first plug member 105, which may comprise, for example, a female plug member. Therefore, the present teachings of the plug retention apparatus 100 as described herein should include various embodiments that are adaptable to male and female plug members.

From the forgoing, it will be appreciated that the plug retention apparatus 100 provides a convenient way in which to secure plug components 120, 200 that are to be joined to one another preventing disengagement until desired. Advantageously, the adjustable aspect of the retention ring 130 provides a mechanism by which to secure a variety of different plug configurations desirably accommodating different plug and cord sizes. Moreover, the ability to angularly displace the plug clamp 135 away from the plug members 105, 202 allows the plug components 120, 200 to be rapidly engaged and disengaged as desired while still maintaining a securing force to the joined plug components when positioned axially in-line with the first plug member 105. Furthermore, the rotating ability of the retention ring 130 can be used to secure the plug members tightly by engaging the plug clamp 135 and then cinching down upon the joined plug members by rotating the retention ring 130 towards the base 115. When such an operation is performed, the plug members may be retained in a tightly secured configuration resilient to separation.

A wide variety of materials may be used to construct the plug retention apparatus 100 and may include by way of example: plastic, nylon, metal, wood, or other materials. In addition, the various components of the plug retention apparatus 100 may be constructed from different materials as desired. Additionally, the retention ring 130 may be adapted to be secured to and moved about the first or second plug member 105, 200 in a manner other than rotatable movement. For example, the retention ring 130 may be adapted with a latching means such that it can be moved up and down the first plug member 105 without rotation of the retention ring 130. In this configuration, the retention ring 130 may be secured to the first plug member by a series of movement-retarding latches as will be appreciated by on of skill in the art. In other embodiments, the plug retention apparatus 100 may be desirably adapted to be formed on a male plug member wherein a female plug member 105 is captured by the plug clamp. Furthermore, the apparatus 100 may be adapted with a variety of other different plug configurations/combinations as desired to securely join the plug members.

Although the foregoing description has shown, described, and pointed out the fundamental novel features of the present teachings, it will be understood that various omissions, substitutions, and changes in the form of the detail of the apparatus as illustrated, as well as the uses thereof, may be made by those skilled in the art, without departing from the spirit of the present teachings. Consequently, the scope of the present teachings should not be limited to the foregoing discussion, but should be defined by the appended claims.

What is claimed is:

1. An electrical cord assembly comprising:

a cord suitable for supplying electrical power to an appliance;

a first plug member having a front face attached to the cord wherein the first plug member includes a threaded surface and wherein the first plug member is adapted to couple to a second plug member having an associated cord so as to provide electrical power thereto;

a retainer assembly threadably engaged with the first plug member so as to be movable in a direction either towards to away from the front face of the first plug member wherein the retainer assembly includes an engagement member that engages with the cord attached to the second plug member and wherein the retainer assembly can be threadably moved on the first plug member away from the front face of the first plug member such that the engagement member can be tightened against the second plug member to thereby retain the first and second plug members in contact with each other.

2. The assembly of claim 1, wherein the first plug member comprises a male electrical cord plug.

3. A method of interconnecting two electrical cords with matching plugs, the method comprising:

inserting a first plug assembly of the first electrical cord into a second plug assembly of the second electrical cord;

threadably engaging a retaining structure onto the first cord assembly having a front face;

coupling the retaining structure to the second electrical cord; and threadaby moving the retaining structure to away from the front face of the first plug assembly such that a portion of the retaining structure engages the second plug assembly and urges the second plug assembly towards the first plug assembly to thereby inhibit disengagement between the first and second plug assemblies.

4. The method of claim 3, wherein inserting a first plug assembly to a second plug assembly includes engaging a first plug member into a second plug member, and wherein the first plug member is electrically coupled to the first electrical cord and the second plug member is electrically coupled to the second electrical cord, and wherein the first and second electrical cords are suitable for supplying electrical power to an appliance.

5. The method of claim 3, wherein the method further comprises pivoting a clamping member about a portion of the retaining structure towards the second electrical cord so as to securely couple therewith.

6. The method of claim 3, wherein threadably moving the retaining structure with respect to the first plug assembly includes threading the retaining structure along a portion of the first plug assembly so as to secure the second plug assembly between the clamping member and the first plug assembly.

7. The method of claim 3, wherein coupling the retaining structure to the second electrical cord includes securing the retaining structure to the second electrical cord with an engagement member that is pivotally attached to a portion of the retaining structure so as to be movable between an open position and a closed position.

8. The method of claim 3, wherein the engagement member in the open position allows the second electrical cord to be positioned in a depression defined by the retaining structure, and wherein the engagement member in the closed position allows the second electrical cord to be secured to the retaining structure.

* * * * *

UNITED STATES PATENT AND TRADEMARK OFFICE

CERTIFICATE OF CORRECTION

PATENT NO. : 7,101,214 B1
APPLICATION NO. : 11/209594
DATED : September 5, 2006
INVENTOR(S) : Thomas J. Miller It is certified that error appears in the above-identified patent and that said Letters Patent is hereby corrected as shown below:

In Column 8, Line 29, Claim 3, please replace “threadaby” with -- threadably --

In Column 8, Line 29, Claim 3, please replace “structure to” with -- structure --

Signed and Sealed this

Eighth Day of May, 2007

JON W. DUDAS
*Director of the United States Patent and Trademark Office*